United States Patent [19]

Noll

[11] 4,018,961

[45] Apr. 19, 1977

[54] LAMINAR ROLLER RINK SURFACE HAVING HIGH SOLIDS CONTENT PRIMER LAYER

[75] Inventor: Barton B. Noll, Blue Springs, Mo.

[73] Assignee: R. C. Sports, Inc., Olathe, Kans.

[22] Filed: Oct. 15, 1976

[21] Appl. No.: 732,886

Related U.S. Application Data

[63] Continuation-in-part of Ser. No. 664,449, March 8, 1975, Pat. No. 3,993,823.

[52] U.S. Cl. ..... 428/213; 427/307; 427/407 R; 428/304; 428/321; 428/414

[51] Int. Cl.[2] ..... B32B 3/28

[58] Field of Search ..... 428/213, 413, 414, 320, 428/321, 304; 427/307, 407 R, 309

[56] References Cited

UNITED STATES PATENTS

| | | | |
|---|---|---|---|
| 2,861,011 | 11/1958 | Asbeck et al. | 427/407 R |
| 3,150,032 | 9/1964 | Rubenstein | 428/320 |
| 3,900,622 | 8/1975 | Caramanian | 428/413 |

*Primary Examiner*—William J. Van Balen
*Attorney, Agent, or Firm*—Schmidt, Johnson, Hovey & Williams

[57] ABSTRACT

A laminar, synthetic resin floor construction especially adapted for roller rinks is provided which resists significant cracking, peeling or delamination characteristic of prior floors of this type, and has a useful life far in excess of such conventional laminated floors. The floor includes a relatively thick, high solids content epoxy primer layer applied over a porous substrate such as acid etched or sandblasted concrete, a thick epoxy resiliency or padding layer applied over and bonded to the primary layer, and a multiple-coat finishing layer applied over the resiliency layer which presents a proper roller skating surface. In preferred forms the primer and resiliency layers are each formed using epoxy resin compositions so that the layers can strongly bond to one another, with the high solids primer layer serving as an effective moisture barrier and base for the resiliency and finishing layer. The preferred method of making the floor includes successively applying the primer and resiliency layers and allowing each to individually dry and cure, followed by spraying the finishing layer in crosswise applied coats in order to complete the floor construction.

17 Claims, No Drawings

LAMINAR ROLLER RINK SURFACE HAVING HIGH SOLIDS CONTENT PRIMER LAYER

This is a continuation-in-part of application Ser. No. 664,949 filed Mar. 8, 1976, now U.S. Pat. No. 3,993,823 and entitled Laminar Roller Rink Surface and Method of Producing Same.

This invention relates to improved laminar floor constructions which are especially adapted for use in roller rinks and which avoid many of the problems common to prior floor constructions of this type such as cracking, peeling or delamination. More particularly, it is concerned with a floor construction which includes a high solids content primer layer applied over and bonded to a porous substrate such as etched concrete, in conjunction with a relatively thick resiliency layer bonded to the primer layer which functions in a manner analogous to a carpet pad, with a finishing layer applied over the resiliency layer which presents a proper roller skating surface.

In the past, owners of roller skating rinks have resorted to a number of expedients in preparing rink floors for skating. One approach has been to use conventional hardwood floors, and while these floors provide an adequate skating surface, the cost of hardwood floors has in recent years become prohibitive and thus not practical for use in new installations. Another type of rink floor used in the past includes sheets of wood by-product particle board applied over concrete slabs and supposedly held in place by a bonding agent. However, experience with these types of floors has demonstrated that it is difficult to effectively bond fiberboard sheets to concrete, and thus the sheets have tended to become loose with adverse consequences for skaters. Finally, efforts have been made in the past to provide a suitable covering for a concrete substrate by successive applications of thin coatings of synthetic resin materials. While these methods have been partially successful, they have nevertheless failed to provide a complete answer to the problem of providing a safe, long-wearing roller rink floor construction. In particular, these prior lamination-type floor constructions have tended to crack, peel and delaminate, thus requiring complete replacement after only three or four months of use.

The conventional approach in applying synthetic resin laminated roller rink floors has been to successively apply and cure coats of synthetic resin material of only a few mils thickness. Such thin coatings are allowed to individually dry and cure and have a relatively high tensile strength, but, by the same token, exhibit a brittleness and lack of resiliency which makes the coating susceptible to peeling. Finally, some difficulty has been encountered in the past in bonding synthetic resin materials such as epoxy directly to the concrete substrate, and this has of course further detracted from the usefulness of prior laminated floor constructions of this type.

A number of prior patents have described floor constructions made up of a number of successively applied layers of synthetic resin material. For example, U.S. Pat. No. 3,549,404 to Roberti et al. describes a floor construction wherein a substrate such as cement is coated with three layers of synthetic resin material. The first coat is of clear or pigmented vinyl acetate/polyurethane emulsion, while the second seal coat is of the same material as the first coat but is thinner than the latter. A final glaze or wear coat of clear solvent based polyurethane material is then applied over the initial coats in order to complete the flooring. The patent of Jenne, U.S. Pat. No. 2,977,863 is directed to a laminar floor construction wherein three layers of acrylic resin emulsion are applied to a substrate. Other prior patents of general interest in this connection are: U.S. Pat. Nos. 2,948,201, 2,306,570, 2,657,153, 2,716,075, 2,984,583, 3,008,848, 3,091,998, e,720,538, 3,769,063, and 3,850,661.

Parent application Ser. No. 664,949 describes a laminar floor construction wherein a relatively dilute, thin epoxy layer is applied to and partially absorbed into a porous concrete substrate. A thick epoxy layer of higher solids content is then applied over the primer layer, followed by a finishing layer which presents a skating surface. Although floor constructions in accordance with application Ser. No. 664,949 have achieved significant commercial success, certain drawbacks remain. For example, many fire codes prohibit the use of epoxy formulations having a high proportion of flammable solvent, and thus the relative dilute primer layer described above may be objectionable. Moreover, while the dilute primer layer is excellent in terms of absorption into and bonding to the concrete substrate, a separate moisture barrier may be needed in some cases because of the low solids content of the primer layer.

It is therefore the most important object of the present invention to provide a laminar synthetic resin floor construction, and a method of fabricating the same, wherein the floor is especially adapted for roller rinks and is resistant to significant cracking, splitting, peeling and delamination over extended periods of hard usage so that the overall expense involved in maintaining a roller rink floor is significantly reduced.

Another object of the invention is to provide a laminar floor construction which includes a cured, relatively high solids content, moisture-impervious primer layer of epoxy material applied over a porous substrate such as acid etched and/or sandblasted concrete, a cured resiliency layer of epoxy material applied over the primer layer and having a thickness and solids content to act in the manner of a resilient carpet pad, and a finishing layer preferably of a cured polyester synthetic resin material applied in multiple coats over the resiliency layer and for presenting a proper surface for roller skating.

Finally, another object of the invention is to provide a multiple-layer synthetic resin floor construction wherein the resin formulations used have very low solvent concentrations in order to obviate the handling and application problems inherent in the use of resin formulations having significant amounts of flammable solvents therein .

Briefly, the present invention is concerned with a laminar floor construction comprising a plurality of specialized synthetic resin layers applied over and bonded to a porous substrate. In fabrication procedures, a smooth, clean concrete surface is treated with acid (e.g., muriatic) in order to etch the concrete, open the porosity thereof, and neutralize the normal alkalinity in the concrete. Optionally, the concrete can be sandblasted, and this technique serves to remove the latentance cap on the concrete. After an adequate etch has been achieved, the acid solution is rinsed from the concrete floor and the latter is allowed to completely dry for a period of 7 to 14 days. A primer layer of high solids content thermosetting polyamine epoxy material is then applied as a relatively thick coat over the concrete in order to present a substantially smooth surface and serve as an effective moisture barrier. The epoxy material contains a cross-linking agent, and is allowed to dry and cure for six hours or more subsequent to application. In this respect, although the majority of the primer material does not normally absorb into the concrete, strong concrete-primer bond is established.

A relatively thick resiliency layer of polyamide epoxy material is next applied on top of the primer layer by means of a notched or serrated trowel. This resiliency coating is generally made up of an epoxy having a somewhat lower solids content than that used for the primer layer, but the relative thickness of the two coats can vary depending principally upon the method of installation. This layer is resistant to cracking and peeling, and functions in a manner analogous to a carpet pad.

In the final step a plurality of thin coats of the top or "rink" coating are applied to the resiliency layer (which has been allowed to dry and cure) in order to present a suitable surface for skating. This multiple coating layer is preferably in the form of a commercially available crosslinked polyester synthetic resin material and is applied by so-called "airless spraying" techniques.

In more detail, the preferred concrete substrate for use in connection with the invention comprises a reinforced, relatively smooth, level, poured concrete base having a compressibility of at least about 2500 psi, and more preferably from 2500–4500 psi, and most preferably about 3000 psi. The base may optionally be provided with a vapor barrier (at least 8 mils in thickness), and the concrete should be naturally cured without the use of curing or bond breaking compounds. Such a concrete base is pretreated by misting with water, whereupon it is etched with dilute muriatic or phosphoric acid (e.g., 2 volumes of water per volume of 20% muriatic acid). The acid is applied over the concrete (1 gallon acid per 35 square feet of concrete surface) with a commercial scrubber and serves to clean the concrete and open the porosity thereof. In addition, the acid neutralizes the normal alkalinity of the concrete base which is important for permitting an adequate bond to be formed with the epoxy material to be applied thereover. After the acid has been allowed to etch the concrete for a period sufficient to accomplish the above purposes, (about 3 to 5 minutes), the acid is flushed off of the concrete substrate with high pressure water or commercial scrubber, and any expansion joints and cracks are filled and sanded. In certain cases, depending upon the condition of the concrete slab, sandblasting may be desirable or necessary. At this point high pressure water is again used to flush and clean the concrete substrate. The treated concrete is then allowed to dry for a period of at least about 7 days, and more preferably for a period of from about 7 to 14 days. The exact drying time of course depends upon ambient temperature and humidity conditions. In other cases the concrete substrate can be treated by conventional scarification techniques in order to improve the bond between the substrate and primer layer applied thereover.

A primer layer of epoxy resin is then applied over the prepared concrete by means of a squeegee and roller. This resin mixture includes an epoxy and a curing agent therefor, so that after application the resin can harden and cure. In this connection, the initially flowable primer layer synthetic resin mixture preferably includes a polyamine thermosetting epoxy resin without added solvent of any type, and an amine curing agent for the epoxy resin. The curing agent is preferably selected from the group consisting of diethylene triamine, triethylenetetramine, tetraethylene pentamine, amidoamines and polyamide resins made up of polymerized fatty acids and polyfunctional amines having a viscosity of from about 200 to 3800 cps (24° C) and an amine value of from about 25 to 400. In addition to the foregoing, it is preferred to use a synthetic resin mixture for the primer layer which has a relatively high solids concentration. This mixture should comprise from about 85-100% solids and more preferably about 100% solids. In this connection a 100% solids epoxy formulation implies that essentially none of the formulation will evaporate upon curing thereof, even though such a formulation is flowable prior to curing. Of course, the precise solids level and application of the primer layer composition can be determined by patch tests on the concrete in order to ensure that the resulting layer is adequate for the purposes of the invention.

A wide variety of epoxy resin formulations can be used in the present invention for both the prime and resiliency layers. In both cases the epoxy resin component should have an epoxide equivalent of from about 150° –325° , a melting point of from 0° –125° C, and a viscosity which exceeds about 500 cps. For the primer composition the amine curing agent can be any of the resin curing agents listed above. In commercial practice, a two-component thermosetting polyamine epoxy formulation sold under the name "Roller Glide Prime" by Conchemco Incorporated of Kansas City, Missouri has been used in the primer layer. This product is sold as a cross-linking agent and epoxy material and is preferably mixed on substantially a five to one volume basis and applied.

The initially flowable epoxy resin composition used to form the primer layer of the floor construction should be applied so that the primer layer has a thickness of from about 0.030 to 0.500 inches, and more preferably from about 0.050 to 0.070 inches in thickness. As discussed above, during initial primer layer application, the resin material is advantageously applied with a squeegee in order to assure a coating thick enough to present a relatively smooth surface over the concrete and act as a moisture barrier. After application, the resin mixture is allowed to dry and cure in the air for a period sufficient to present a dried residue as the primary layer. In the case of the preferred primer composition described above, this drying time should be at least about 6 hours.

The resiliency layer is preferably applied as a relatively thick single coat with a notched or serrated trowel. The initially flowable synthetic resin mixture used in forming the resiliency coat should include an epoxy resin and a curing agent therefor. The solids concentration in the resiliency composition is generally less than that of the mixture used for the primer layer, and in particular should be at least about 40% solids and more preferably from about 85 to 100% solids. In this connection, a BPA-type thermosetting epoxy resin mixture and cross-linking component selected from the group consisting of diethylene triamine, triethylenetetramine, tetraethylene pentamine and polyamide resins made up of polymerized fatty acids and polyfunctional amines having a viscosity of from about 200 to 3800 cps (24° C) and an amine value of from about 25 to 400 are preferably used in the resiliency layer composition;

in addition, a solvent containing a ketone and an alcohol (perferably an aliphatic lower alcohol having from 1 to 4 carbon atoms) is employed where necessary in the resiliency layer composition to give the proper solids content. The most preferred solvent comprises equal amount on a volume basis of methylethylketone and 99% isopropyl alcohol. If the resiliency layer is applied during high humidity atmospheric conditions, it may be advisable to include a small amount (e.g., 2 oz. per gallon) of butyl Cellosolve in the resiliency layer composition.

The resiliency layer composition is applied over the primer layer in order to achieve a layer thickness of from about 0.030 to 0.500 inches, and more preferably from about 0.050 to 0.150 inches. After manual application of the resiliency layer, the latter is allowed to harden and cure in the air for a period of at least about 12 hours, and more preferably at least about 24 hours.

The final layer of the floor construction includes the dried residue of a synthetic resin mixture which is bonded to the resiliency layer and presents a floor surface. In the case of roller rink floors, a polyester resin having a suitable cross-linking agent therein is preferably used, one such product being a cross-linked polyester sold under the designation "Rink-cote, Type E" by the Port City Paint Co. of Muskeegee, Michigan. This product is sold as separate components that are mixed and allowed to sit for approximately one hour prior to application.

Although the rink coating can be applied by manual methods such as through the use of a squeegee, it is preferred to apply the finishing layer over the resiliency layer in the form of multiple coats which are sprayed by so-called "airless spray". In particularly preferred forms, an initial coating of the synthetic resin mixture is sprayed in a first general direction at a thickness of approximately 2 to 8 mils and is allowed to dry. If needed a second interlaced coating of similar thickness is then applied over the tacky initial coating in a crosswise direction (preferably generally perpendicular) to the first application direction. At this point, the coatings are allowed to dry and cure to present the complete finishing layer. In the case of the "Rink-cote, Type E" product, the curing time should be at least about 72 hours, but depending upon atmospheric conditions, this may take as much as a full week. In its final form, the finishing layer should have a thickness of from about 0.015 to 0.025 inches, although the exact thickness of this final layer is not critical. It should also be pointed out that a number of individual coatings of the final sprayed on material could also be applied without departing from the principles of the invention.

After completion, the laminar floor construction in accordance with the invention presents an excellent floor for roller rinks or the like. A prime feature of the floor construction resides in the use of a high solids content primer layer in conjunction with a relatively thick, concentrated resiliency layer, each of which comprise the dried residue of a synthetic resin composition containing epoxy and a cross-linking agent therefor; this ensure that an adequate moisture barrier is provided and makes it possible to establish a firm bond between the primer layer and thick resiliency layer. The latter is important in providing the necessary "give" in the floor construction so that the floor can resist cracking, peeling and delamination. Absent a resiliency layer, the floor construction could be prone to such problems and in general could not provide the extended service that floors in accordance with the present invention can provide.

Having thus described the invention, what is claimed as new and desired to be secured by Letters Patent is:

1. A laminar floor construction, comprising: a porous substrate;

a cured primer layer applied over said substrate and including the dried residue of a first synthetic resin mixture which includes an epoxy resin and a curing agent therefor and has a solids content ranging from about 85 to 100%;

a cured resiliency layer applied over and bonded to said primer layer, said resiliency layer having a thickness of from about 0.030 to 0.500 inches and comprising the dried residue of a second synthetic resin mixture which includes an epoxy resin and a curing agent therefor; and a finishing layer applied over and bonded to said resiliency layer and including the dried residue of a third synthetic resin mixture which presents a floor surface.

2. The laminar floor construction of claim 1 wherein the solids content of said first mixture is about 100%.

3. The laminar floor construction of claim 1 wherein said second mixture includes an epoxy resin, a solvent having a ketone and an alcohol therein, and an aliphatic amine curing agent for the epoxy resin.

4. The laminar floor construction of claim 3 wherein said solvent includes substantially equal amounts, on a volume basis, of methylethylketone and isopropyl alcohol.

5. The laminar floor construction of claim 1 wherein said curing agent for said first mixture is selected from the group consisting of diethylene triamine, triethylenetetramine, tetraethylene pentamine, the amidoamines, and the polyamide resins made up of polymerized fatty acids and polyfunctional amines having a viscosity of from about 200 to 3800 cps (24° C) and an amine value of from about 85 to 400.

6. The laminar floor construction of claim 1 wherein said second mixture has a solids content of at least about 40%.

7. The laminar floor construction of claim 6 wherein said solids content is from about 85–100%.

8. The laminar floor construction of claim 1 wherein the epoxy resin in said first and second mixtures each have an epoxide equivalent of from about 150° –325°, a melting point of from about 0° –125° C, and a viscosity of at least about 500 cps.

9. The laminar floor construction of claim 1 wherein said primer layer is from about 0.030 to 0.500 inches in thickness.

10. The laminar floor construction of claim 1 wherein said primer layer is from about 0.050 to 0.070 inches in thickness.

11. The laminar floor construction of claim 1 wherein said finishing layer comprises at least two separate coats of said third mixture successively applied over said resiliency layer.

12. The laminar floor construction of claim 1 wherein said third synthetic resin mixture is a polyester.

13. The laminar floor construction of claim 1 wherein said finishing layer has a thickness of from about 0.015 to 0.025 inches.

14. The laminar floor construction of claim 1 wherein said substrate is acid etched concrete.

15. A method of constructing a laminar floor comprising the steps of:

providing a porous substrate;

applying a first synthetic resin mixture which includes an epoxy resin, a curing agent therefor, and a solids content varying from about 85 to 100%, over said substrate, and allowing said first mixture to dry and cure to present a primary layer;

applying a second synthetic resin mixture over said primer layer which includes an epoxy resin and a curing agent therefor, and allowing said mixture to cure and bond to the primer layer to present a resiliency layer, said second mixture being applied in an amount such that the resiliency layer has a thickness of from about 0.030 to 0.500 inches; and applying a third synthetic resin mixture over said resiliency layer and allowing the third mixture to dry and cure to thereby present a finishing layer.

16. The method of claim 17 including the steps of providing a concrete surface, etching the latter with acid, washing the etched surface with water, and allowing the surface to dry.

17. The method of claim 15 including the steps of applying an initial coating of said third mixture over said resiliency layer in a first general direction, allowing the initial coat to become tacky, applying a second coating of the third mixture over the tacky initial coating in a second general direction crosswise to said first direction, and allowing said first and second coatings to dry and cure to present said finishing layer.

* * * * *